US006619434B1

(12) United States Patent
Smith et al.

(10) Patent No.: US 6,619,434 B1
(45) Date of Patent: Sep. 16, 2003

(54) METHOD AND APPARATUS FOR INCREASING THE TRAFFIC HANDLING PERFORMANCE OF AN ELEVATOR SYSTEM

(75) Inventors: Rory Stephen Smith, El Cajon, CA (US); Richard D. Peters, Bucks (GB)

(73) Assignee: Thyssen Elevator Capital Corp., Whittier, CA (US)

( * ) Notice: Subject to any disclaimer, the term of this patent is extended or adjusted under 35 U.S.C. 154(b) by 0 days.

(21) Appl. No.: 10/113,517

(22) Filed: Mar. 28, 2002

(51) Int. Cl.[7] ..... B66B 5/14
(52) U.S. Cl. ..... 187/281; 187/295
(58) Field of Search ..... 187/276, 281, 187/286, 289, 293, 295, 296, 297; 318/59, 61, 66, 798–815

(56) References Cited

U.S. PATENT DOCUMENTS 4,751,984 A * 6/1988 Williams et al. ..... 187/293
5,035,301 A * 7/1991 Skalski ..... 187/295
5,076,399 A * 12/1991 Horbruegger et al. ..... 187/293
5,241,141 A 8/1993 Cominelli
5,266,757 A 11/1993 Krapek et al.
5,298,695 A * 3/1994 Bahjat et al. ..... 187/295
5,407,030 A * 4/1995 Burton et al. ..... 187/392
5,424,498 A * 6/1995 Spielbauer et al. ..... 187/292
5,635,688 A * 6/1997 Kantesaria et al. ..... 187/292
5,723,968 A 3/1998 Sakurai
6,199,667 B1 3/2001 Fishgold et al.
6,311,802 B1 11/2001 Choi et al.

* cited by examiner

*Primary Examiner*—Jonathan Salata
(74) *Attorney, Agent, or Firm*—White & Case LLP

(57) ABSTRACT

A method and apparatus for utilizing unused power available in an elevator that is not fully loaded to improve the traffic handling capacity of an elevator system. The present invention can be used to provide an optimized velocity profile for the elevator based on the pre-designed power of the drive motor and the actual load in the elevator. By using the surplus power available the method and apparatus of the invention can achieve velocities higher than the design velocity of the system. The method also utilizes surplus torque available to the motor during a trip to produce an optimized velocity profile that has a short trip time, yet does not exceed the torque deliverable by the motor and does not exceed acceptable discomfort levels to the passengers or mechanical limitations on the system.

12 Claims, 1 Drawing Sheet

METHOD AND APPARATUS FOR INCREASING THE TRAFFIC HANDLING PERFORMANCE OF AN ELEVATOR SYSTEM

FIELD OF THE INVENTION

The present invention is directed to the field of elevators and elevator control systems. In particular, the present invention concerns a method and apparatus for controlling a partially loaded elevator and utilizing the surplus power of the elevator motor during that partially loaded state to provide an optimized velocity profile for the elevator and reduce travel times for particular calls. The method and apparatus of the invention improve the overall performance of the elevator system. The invention also provides a method for modeling a variety of velocity profiles based on the available torque of the motor and the particular information about a trip and selecting a profile having the shortest travel time yet meeting the constraints of the system.

BACKGROUND OF THE INVENTION

Traction drive elevators in the industry have traditionally been pre-set to operate at a maximum design speed during operation without any variation. In traction drive elevators, a series of ropes connected to an elevator car extend over a drive sheave (and one or more secondary sheaves) to a counterweight. The ropes may be connected directly to the car and counterweight or to sheaves coupled thereto. Lifting force to the hoist ropes is transmitted by friction between the grooves of a drive sheave and the hoist ropes. The weight of the counterweight and the car cause the hoist ropes to seat properly in the grooves of the drive sheave.

Traction drive elevators are typically designed to operate at a certain maximum speed, for example 500 fpm, based on the maximum load capacity of the elevator. However, conventional traction drive elevators never exceed the maximum speed even if the load in the car is less than capacity. Drive motors for traction drive elevators are designed to provide the power needed to obtain maximum speed. For example, the following equation may be used to calculate design power of a drive motor in an elevator system:

$$HP = \frac{(1-(cw \div 100)) \times CAPA \times VEL_{design}}{33{,}000 \times (EFF \div 100)} \quad (1)$$

wherein,

HP is power (in horsepower), cw is the counterweight (as a % of the maximum car capacity)

CAPA is the maximum car capacity (lbs.), $VEL_{design}$ is the pre-set design velocity of the elevator (fpm), and EFF is the efficiency of the elevator (%), which for example is 50–85% in geared systems and 80–95% in gearless systems.

Conventional practice for traction drive systems has been to utilize a counterweight whose weight equals the empty weight of the elevator car plus 50% of the car's capacity. As an example, for a 3,000 lb. capacity elevator with an empty car weight of 4,000 lbs., the counterweight would weigh 5,500 lbs. In this arrangement, the power required to displace the elevator is at a maximum when the elevator car is either empty or filled to capacity. When the elevator is filled to one-half of capacity (such as 1,500 lbs. in the example given above) the power required to displace the elevator is at a minimum because the forces in the ropes on each side of the drive sheave are equal.

Passenger elevators must be designed to carry freight and as well as people of varying weights. Passenger elevator capacity is always calculated conservatively. Elevators, when volumetrically filled with people, are rarely operating with full loads even during peak traffic periods. The weight of the people in a fully loaded passenger elevator rarely if ever equals 80% of the design capacity. In most cases, an elevator that is so crowded that it will not accept an additional passenger has a load that is approximately equal to 60% of full load capacity.

Modem traction drive elevator systems utilize variable speed drives (VSD). These drives are designed to deliver a specified amount of current to the motor. Since current is directly related to power, the size of these drives are usually rated by current, power, or both. In addition to system software that limits maximum velocity of the car, the VSD also limits maximum velocity.

Modem elevator systems also now use load-weighing devices that can precisely measure the load in the car. Various approaches to load measurement are used, including load cells, piezoelectric devices, and displacement monitors. All of these systems can consistently calculate the load in an elevator cabin to within 1% of its capacity. For example, in an elevator with a maximum capacity of 2,000 lbs., it is possible to measure the load in the cabin within 20lbs.

In some instances, the prior art has used variable speed drives to control the motion of elevator cars in response to the load carried by the car. For example, U.S. Pat. No. 5,241,141, issued Aug. 31, 1993, to Cominelli, shows an elevator system including variable speed motor controlled in response to a selected motion profile to effect desired operation of the elevator car. Multiple elevator car motion profiles are stored in the memory of the controller. Depending upon whether or not an occupant is present in the elevator car, the controller selects either a comfortable high quality ride profile having an increased flight time and lower acceleration and jerk rates or a high performance profile having a decreased flight time and higher acceleration and jerk rates. If no passengers are detected in the elevator car by sensing the weight of the elevator car and its occupants, and by sensing the lack of car calls, then the elevator car is free to be dispatched to a floor having a hall call at a high performance rate to minimize the flight time to reach that floor.

U.S. Pat. No. 5,723,968, issued Mar. 3, 1998, to Sakurai, discloses variable speed elevator drive system for automatically discriminating between large and small loads, and for adjusting a maximum cage speed (maximum output frequency) in accordance with the load. The system comprises voltage and current detection circuits and a CPU which discriminates between large and small loads from a value obtained by averaging a detected current. The system automatically adjusts the maximum output frequency by determining whether the elevator is running in a regenerative state or a power state. According to the patent, by making variable the current detection range and period, and using a first order lag filter time constant in averaging the current, an optimal maximum output frequency corresponding to the load may be selected to improve the operating efficiency even when fluctuations in the load are large.

The prior art, however, has not recognized or suggested improving the performance of a traction drive elevator system by determining if the car is in a partially loaded state for a particular trip (i.e., a state where the load on the motor is less than maximum) and utilizing the excess power of the drive motor to alter the velocity profile of the car on the particular trip. The method and apparatus of the present invention achieve this objective and are able to alter the velocity profile by increasing the top speed of the car, or by accentuating the acceleration or jerk rates during a particular the trip ultimately to reduce the time of the trip.

SUMMARY OF THE INVENTION

The invention comprises a method for increasing the traffic handling performance of an elevator driven by a drive motor having a pre-designed power, which is defined as the power required to drive the elevator according to a design velocity profile when there is a full load on the drive motor. The elevator serves a plurality of floors in a building and is preferably driven by a variable speed drive motor, which is preferably programmable on a per trip basis.

The method of the invention includes the steps of (i) measuring the actual load in the car for a particular trip; (ii) determining if the load represents a partial load on the drive motor; (iii) calculating an optimized velocity profile for the car on the trip as a function of the pre-designed power of the drive motor and the actual load in the car; and (iv) programming the drive motor to execute the optimized velocity profile for the trip.

In the method of the invention, the optimized velocity profile may have a maximum velocity greater than the maximum velocity of the design velocity profile, or may have an accentuated acceleration rate or jerk rate when compared to those of the design velocity profile for the system.

In one preferred embodiment, the method includes calculating an optimized velocity having a maximum velocity higher than the design velocity for the system as a function of the pre-designed power of the drive motor and the actual load according to the following algorithm:

$$VEL_{opt} = \frac{HP \times 33{,}000 \times EFF}{|((1-(cw \div 100)) \times CAPA) - L_{actual}|} \quad (2)$$

wherein, $VEL_{opt}$=the optimized velocity attainable for the actual load (fpm)

HP=pre-designed power of the motor (in horsepower)

EFF=the efficiency of the system (a known value), cw is the counterweight (as a % of the maximum car capacity)

CAPA is the maximum car capacity (lbs.), $L_{actual}$=the actual load inside the car.

In the instance where an optimized velocity profile having a maximum velocity higher than the preset design velocity is generated, the method of the invention may further comprise the step of comparing (i) the maximum velocity of the optimized velocity profile (such as $VEL_{opt}$), (ii) a maximum velocity attainable for the distance of the trip; and (iii) a maximum velocity attainable with the mechanical equipment of the system, and then choosing the lowest velocity from the comparison to be used in generating a velocity profile for the trip. The comparison accounts for the instance where it is simply not possible to reach the maximum velocity of the optimized profile because of trip or system constraints.

The invention also comprises an apparatus for performing the method of the invention. In particular, the apparatus includes a means for measuring the actual load in the elevator for a particular trip; means for determining if the actual load represents a partial load on the drive motor; means for calculating an optimized velocity profile for the trip as a function of the pre-designed power of the drive motor and the actual load; and means for programming the drive motor to execute the optimized velocity profile for the trip.

In a preferred embodiment, the apparatus includes a load weighing component for measuring the actual load in the elevator for a particular trip. The load weighing device may be a load cell, piezoelectric device or displacement monitor.

The apparatus also includes a controller having a load determining unit for receiving information from the load weighing component and determining if the actual load represents a partial load on the drive motor. The controller also includes a calculating unit for generating an optimized velocity profile for the trip, the optimized velocity profile being a function of the pre-designed power of the drive motor and the actual load; and a programming unit for programming the drive motor to execute the optimized velocity profile for the trip. In one embodiment, the apparatus further includes a comparator for comparing (i) the maximum velocity of the optimized velocity profile, (ii) a maximum velocity attainable for the distance of the trip; and (iii) a maximum velocity attainable with the mechanical equipment of the system choosing the lowest velocity from said comparison.

Another embodiment of the invention is a method for increasing the traffic handling performance of an elevator driven by a drive motor having a pre-designed maximum available torque. The method includes measuring the actual load within the car for a particular trip; modeling a range of velocity profiles with varying velocity, acceleration, and jerk rates based on the actual load and information about the particular trip; calculating the resulting torque demand and travel time for each profile; and selecting the velocity profile with the shortest travel time and with a torque demand that does not exceed the maximum available torque of the drive motor. The selecting step preferably requires the selecting a velocity profile that does not impose undue discomfort on the passengers for the trip and does not exceed the mechanical safety limitations of the system.

DETAILED DESCRIPTION OF THE INVENTION

Figure 1:
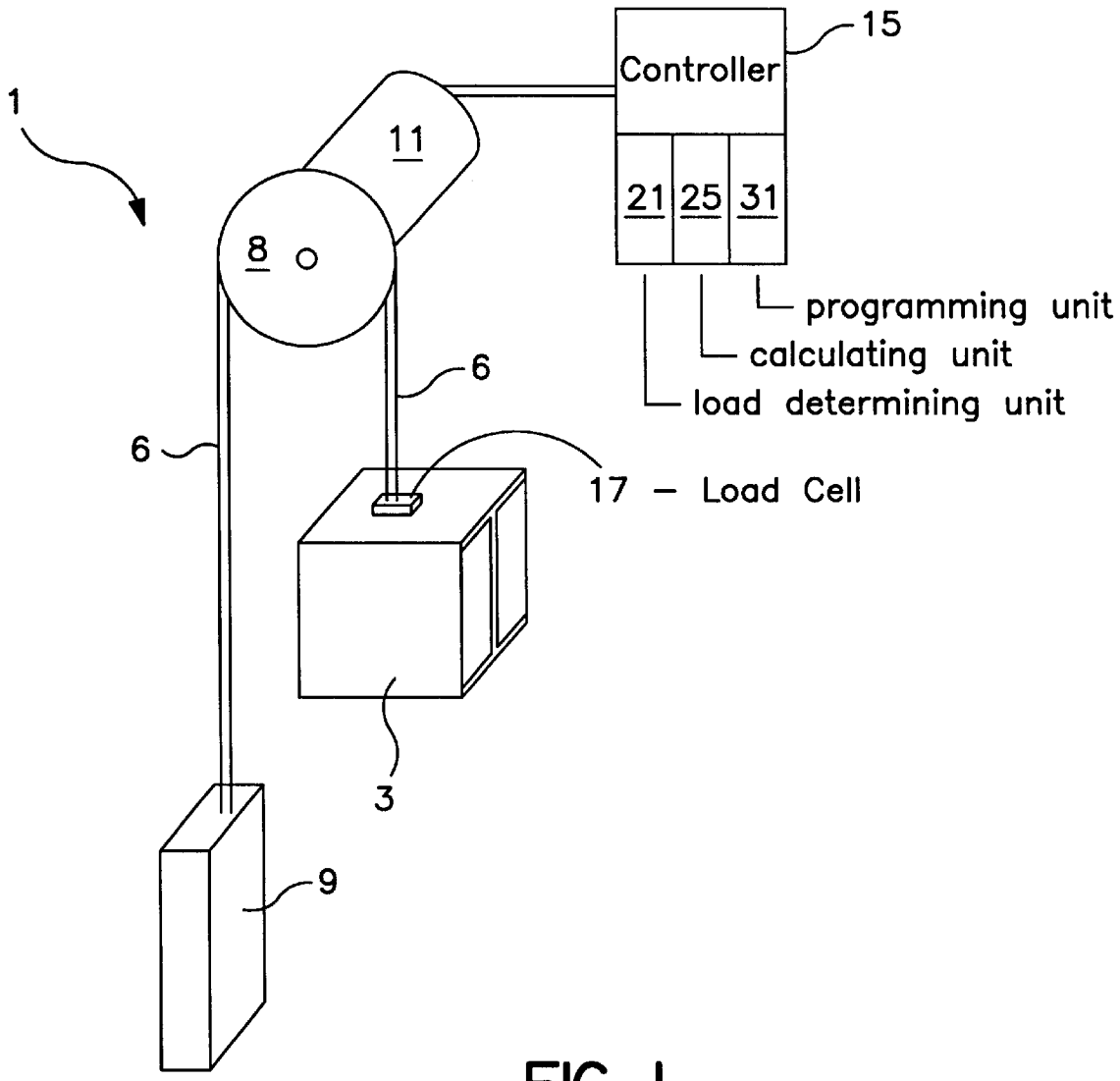
FIG. 1 shows a schematic diagram of an elevator system of an embodiment of the claimed invention.

This invention is based on the concept of utilizing the unused power available in an elevator that is not fully loaded (i.e., not imparting a full load on the drive motor) to improve the traffic handling capacity of an elevator system. The invention comprises a drive control and a velocity-determining algorithm.

FIG. 1 shows an elevator system 1 employing a controller according to the invention. The system includes an elevator car 3 suspended by a hoist rope 6 which passes over a drive sheave 8 and is connected at an opposite end to a counterweight 9. The drive sheave 8 is powered by a drive motor 11, which is preferably a variable speed drive. The drive motor 11 has a pre-designed power to achieve a design velocity for the system.

The system also includes a controller 15, which contains the appropriate motor control electronics to send signals to the drive that cause the drive motor 11 to rotate the drive sheave 8 according to a specified velocity pattern.

A load weighing device, such as a load cell 17, measures the actual load of passengers (or freight) inside the elevator car 3. A signal indicative of actual load is sent from the load cell 17 to a the controller 15 via a traveling cable (not shown) which is attached to the car 3 or other means.

The controller 15 contains a load determining unit 21 that receives the signal from the load cell 17 and determines if the actual load represents a partial load on the drive motor 11 by taking into consideration the weight of the actual load and whether the particular trip will require the drive motor 11 to run in a power state or a regenerative state. The controller 15 also includes a calculating unit 25 which generates an optimized velocity profile in the case where the load determining unit 21 identifies a partial load on drive motor 11. The calculating unit 25 generates the optimized velocity profile as a function of the actual load and the pre-designed power of the drive motor 11.

The controller includes a programming unit 31 which programs the drive motor 11 to execute the optimized velocity pattern for the trip. The load determining unit 21, calculating unit 25, and programming unit 31 may be separate units within the controller or may be part of a single processor of the controller that executes these functions and possibly other functions.

The calculating unit 25 preferably uses a velocity-determining algorithm to generate the optimized velocity pattern. The velocity-determining algorithm is based upon an equation solving for the velocity as a function of the pre-designed power of the motor and the relative weight of the components in the system, including the actual loading of the elevator for a particular trip. The algorithm may be stated as follows:

$$VEL_{opt} = \frac{HP \times 33{,}000 \times EFF}{|((1-(cw \div 100)) \times CAPA) - L_{actual}|} \tag{2}$$

wherein, $VEL_{opt}$=the optimized velocity attainable for the actual load (fpm)

HP=pre-designed power of the motor (in horsepower)

EFF=the efficiency of the system (a known value), cw is the counterweight (as a % of the maximum car capacity)

CAPA is the maximum car capacity (lbs.), $L_{actual}$=the actual load inside the car.

The algorithm permits an elevator loaded between zero load and 100% load to achieve velocities higher than design velocity. The maximum velocity for any journey between any two predefined floors is the lowest of three velocities. These velocities are as follows:

1. The maximum velocity attainable according to Equation No. 2;
2. The maximum velocity attainable for the distance between the two floors. This distance is defined by the acceleration rate and jerk rates, motor and drive capabilities, and by human comfort factors; and
3. The maximum velocity attainable with the mechanical equipment selected for the elevator.

In a preferred embodiment, the controller 15 also includes a comparator feature that compares the above three velocities. The calculating unit 21 then generates an optimized velocity pattern based on the lowest the three velocities.

As an example, using Equation No. 1, a motor having a pre-designed power of 28.41 horsepower would be required to drive a 3,000 lb capacity elevator at a design velocity 500 fpm in a system having a counterweight that is 50% of the capacity and having an efficiency value of 80%. From Equation No. 2 it is possible to solve maximum velocity of an optimized velocity profile for the same elevator when the elevator is loaded to 60% (i.e. 1800 lbs.) of capacity. The result is a maximum speed of 2500 fpm. Thus, the motor can attain this velocity in the 60% loaded elevator. In practice, the distance of the trip, human factors, or the limitations on the mechanical equipment will limit the ultimate velocity attainable. Nevertheless, the invention in many instances would yield velocities higher than the design velocity of the system.

The invention depends on modem variable speed drives that can be programmed on a per trip basis, current generation load weighing devices, and modern elevator control systems that can dictate velocity on a per trip basis. While maximum velocity can be calculated based upon surplus power, surplus torque may also be used to calculate maximum velocity.

Another aspect of the invention recognizes that most often the primary limiting factor of an elevator system is the maximum available torque that the drive motor can produce during a trip. The following equation sets forth relationship between the pre-designed power of the drive motor and the torque the motor is capable of delivering:

$$HP = \frac{T \times RPM}{5252} \tag{3}$$

wherein,

HP is power (in horsepower)

T is torque (in foot-pounds)

RPM is the number of rotations per minute of the motor.

In operation, the torque demand on a drive motor is greatest during the acceleration phase of "full car up" period, in which the load on the drive motor is maximized (system operating a maximum imbalance and maximum inertia). The motor must be designed to accommodate this torque demand.

Traffic performance may be improved even during "full car up" period through the appropriate choice of acceleration and jerk rates and the top speed for a trip. For example, on a long trip, the velocity profile could be set to accelerate at a slower rate, but for a longer period and to a higher speed. The resulting trip time is less, but the velocity profile never requires a torque demand higher than the maximum available torque. At other times (not full car up), it is also possible to improve traffic handling performance by selecting a velocity profile most-suited to the particular call.

In this embodiment of the invention, the method comprises the following steps: (i) measuring the actual load within the car; (ii) modeling a range of velocity profiles with different velocity, acceleration, and jerk rates based on the measured load and information about the particular trip; (iii) calculating the resulting torque demand profile and travel time for each profile; and (iv) selecting the velocity profile having the best travel time for the trip. The selection step is governed by three constraints: the maximum available torque (and braking torque when regenerating rather than motoring); the comfort of the passenger for the trip (governed by acceleration/jerk rates); and the mechanical limitations on the system. The selection step requires choosing the trip with the shortest travel time that does not require a torque demand greater than the motor can deliver. In addition, the velocity profile selected should have acceleration/jerk rates that do not impose undue discomfort on the passengers for the trip, and the profile should be within the mechanical safety limitations of the system.

What is claimed is:

1. A method for increasing the traffic handling performance of an elevator driven by a drive motor having a pre-designed power required to move the elevator according to a design velocity profile when there is a full load on the drive motor, the method comprising:

measuring the actual load in the elevator for a particular trip;

determining if the actual load represents a partial load on the drive motor;

calculating an optimized velocity profile for the trip, the optimized velocity profile being a function of the pre-designed power of the drive motor and the actual load and having a maximum velocity greater than the maximum velocity of the design velocity profile;

comparing (i) the maximum velocity of the optimized velocity profile, (ii) a maximum velocity attainable for the distance of the trip; and (iii) a maximum velocity attainable with the mechanical equipment of the system, choosing the lowest velocity from said comparison; and programming the drive motor to execute the optimized velocity profile for the trip, wherein the optimized velocity profile utilizes said lowest velocity.

2. The method according to claim 1, wherein the optimized velocity profile has an acceleration rate greater than the acceleration rate of the design velocity profile.

3. The method according to claim 1, wherein the optimized velocity profile has a jerk rate greater than the jerk rate of the design velocity profile.

4. A method for increasing the traffic handling performance of an elevator driven by a drive motor having a pre-designed power required to move the elevator according to a design velocity when there is a full load on the drive motor, the method comprising:

measuring the actual load in the car for a particular trip;

determining if the actual load represents a partial load on the drive motor; and calculating an optimized velocity higher than the design velocity for the system, the optimized velocity being a function of the pre-designed power of the drive motor and the actual load according to the following relation:

$$VEL_{opt} = \frac{HP \times 33{,}000 \times EFF}{|((1-(cw \div 100)) \times CAPA) - L_{actual}|} \quad (2)$$

where, $VEL_{opt}$=the optimized velocity attainable for the actual load (fpm)

HP=pre-designed power of the motor (in horsepower)

EFF=the efficiency of the system (a known value), cw is the counterweight (as a % of the maximum car capacity)

CAPA is the maximum car capacity (lbs.), $L_{actual}$=the actual load inside the car; and programming the drive motor to execute the optimized velocity profile for the trip.

5. The method according to claim 4, further comprising:

comparing (i) $VEL_{opt}$, (ii) a maximum velocity attainable for the distance of the trip; and (iii) a maximum velocity attainable with the mechanical equipment of the system;

choosing the lowest velocity from said comparison; and programming the drive motor to execute a velocity profile utilizing said lowest velocity.

6. An apparatus for increasing the traffic handling performance of an elevator driven by a drive motor having a pre-designed power required to move the elevator according to a design velocity profile when there is a full load on the drive motor, the method comprising:

means for measuring the actual load in the elevator for a particular trip;

means for determining if the actual load represents a partial load on the drive motor;

means for calculating an optimized velocity profile for the trip, the optimized velocity profile being a function of the pre-designed power of the drive motor and the actual load, and having a maximum velocity greater than the maximum velocity of the design velocity profile;

means for comparing (i) the maximum velocity of the optimized velocity profile; (ii) a maximum velocity attainable for the distance of the trip; and (iii) a maximum velocity attainable with the mechanical equipment of the system choosing the lowest velocity from said comparison; and means for programming the drive motor to execute the optimized velocity profile for the trip, wherein the optimized velocity profile utilizes said lowest velocity.

7. The apparatus according to claim 6, wherein the optimized velocity profile has an acceleration rate greater than the acceleration rate of the design velocity profile.

8. The method according to claim 6, wherein the optimized velocity profile has a jerk rate greater than the jerk rate of the design velocity profile.

9. An apparatus for increasing the traffic handling performance of an elevator driven by a drive motor having a pre-designed power required to move the elevator according to a design velocity when there is a full load on the drive motor, the method comprising:

means for measuring the actual load in the car for a particular trip;

means for determining if the actual load represents a partial load on the drive motor; and means for calculating an optimized velocity higher than the design velocity for the system, the optimized velocity being a function of the pre-designed power of the drive motor and the actual load according to the following relation:

$$VEL_{opt} = \frac{HP \times 33{,}000 \times EFF}{|((1-(cw \div 100)) \times CAPA) - L_{actual}|} \quad (2)$$

where, $VEL_{opt}$=the optimized velocity attainable for the actual load (fpm)

HP=pre-designed power of the motor (in horsepower)

EFF=the efficiency of the system (a known value), cw is the counterweight (as a % of the maximum car capacity)

CAPA is the maximum car capacity (lbs.), $L_{actual}$=the actual load inside the car; and means for programming the drive motor to execute the optimized velocity profile for the trip.

10. The apparatus according to claim 9, further comprising:

means for comparing (i) $VEL_{opt}$, (ii) a maximum velocity attainable for the distance of the trip; and (iii) a maximum velocity attainable with the mechanical equipment of the system;

means for choosing the lowest velocity from said comparison; and means for programming the drive motor to execute a velocity profile utilizing said lowest velocity.

11. An apparatus for increasing the traffic handling performance of an elevator driven by a drive motor having a pre-designed power required to move the elevator according to a design velocity profile when there is a full load on the drive motor, the method comprising:

a load weighing component for measuring the actual load in the elevator for a particular trip; and a controller component including:

(a) a load determining unit for receiving information from the load weighing component and determining if the actual load represents a partial load on the drive motor;

(b) a calculating unit for generating an optimized velocity profile for the trip, the optimized velocity profile being a function of the pre-designed power of the drive motor and the actual load, the calculating unit generating an optimized velocity profile according to the following relation:

$$VEL_{opt} = \frac{HP \times 33{,}000 \times EFF}{|((1-(cw \div 100)) \times CAPA) - L_{actual}|} \quad (2)$$

where, $VEL_{opt}$=the optimized velocity attainable for the actual load (fpm)

HP=pre-designed power of the motor (in horsepower)

EFF=the efficiency of the system (a known value), cw is the counterweight (as a % of the maximum car capacity)

CAPA is the maximum car capacity (lbs.), $L_{actual}$=the actual load inside the car; and (c) a programming unit for programming the drive motor to execute the optimized velocity profile for the trip.

12. The apparatus according to claim 11, wherein the controller further comprises a comparator unit for comparing (i) $VEL_{opt}$; (ii) a maximum velocity attainable for the distance of the trip; and (iii) a maximum velocity attainable with the mechanical equipment of the system, and the programming unit programs the drive motor to execute a velocity profile utilizing the lowest velocity from said comparison.

* * * * *